US005472207A

United States Patent [19]

Sullivan, Jr. et al.

[11] Patent Number: 5,472,207

[45] Date of Patent: Dec. 5, 1995

[54] BOARD GAME AND METHOD OF PLAYING THE SAME

[76] Inventors: Robert O. Sullivan, Jr.; Debra M. Sullivan, both of 4325 130th St. East, Dundas, Minn. 55019

[21] Appl. No.: 384,864

[22] Filed: Feb. 7, 1995

[51] Int. Cl.[6] ..... A63F 3/00

[52] U.S. Cl. ..... 273/249

[58] Field of Search ..... 273/242, 243, 273/248, 249, 292, 296, 429, 431

[56] References Cited

U.S. PATENT DOCUMENTS

| | | | |
|---|---|---|---|
| 3,068,010 | 12/1962 | Hagopian | 273/302 X |
| 3,939,578 | 2/1976 | Coffey | 273/243 X |
| 4,566,698 | 1/1986 | Sneden | 273/249 |
| 4,714,254 | 12/1987 | Calloway | 273/249 |
| 4,714,255 | 12/1987 | Henry et al. | 273/249 |
| 4,889,345 | 12/1989 | Wawryk | 273/290 X |
| 4,907,808 | 3/1990 | Turner et al. | 273/250 X |
| 4,984,805 | 1/1991 | Medlock | 273/248 |
| 5,092,606 | 3/1992 | Miller | 273/249 |

*Primary Examiner*—William E. Stoll
*Attorney, Agent, or Firm*—Briggs and Morgan

[57] ABSTRACT

A game is provided where point values are awarded based upon the number and difficulty of factual connections or linkages provided by an answering player between a category and a subcategory or two categories. The player moves a game piece from a starting space to a finishing space along a playing path preferably having a star shaped configuration. The number of spaces moved equals the total of the point values earned by identifying the factual connections during a player's given turn. The categories and factual connections used as representative examples relate to the motion picture industry, however the game method may be applied to a variety of subjects for entertainment or educational purposes. Alternate embodiments, including computer, multimedia, and performance versions are described.

23 Claims, 5 Drawing Sheets

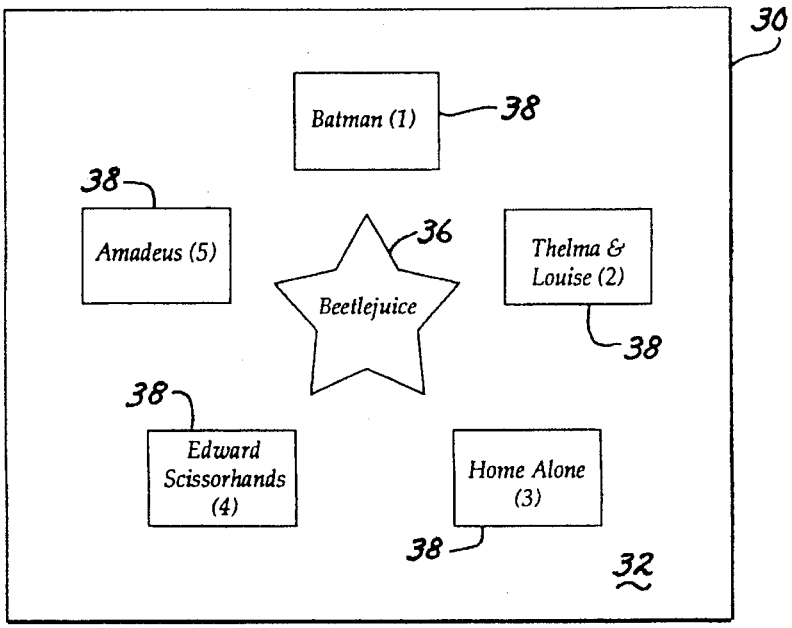
Figure 2a
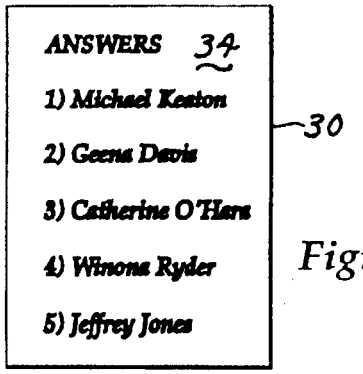
Figure 2b
Figure 5
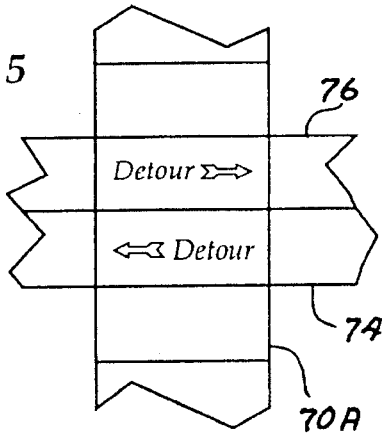
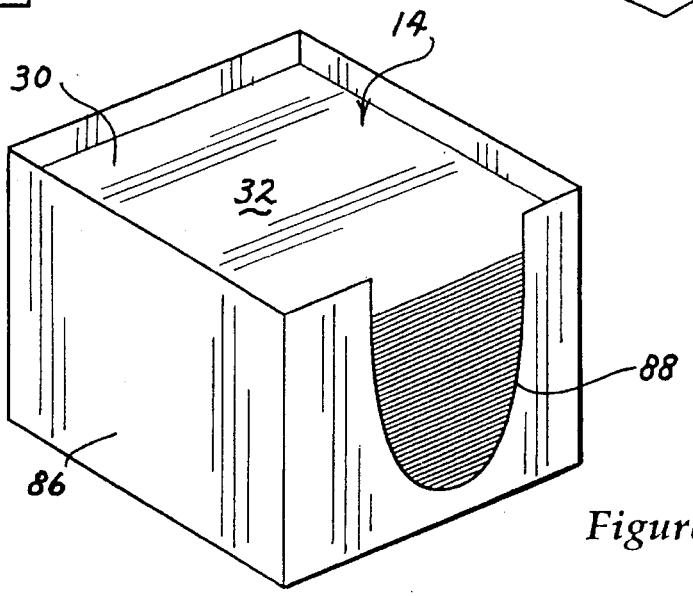
Figure 6

1) Starting Movie: BEETLEJUICE

Actor: _____

2) Movie: THE HUNT FOR RED OCTOBER

Actor: _____

3) Movie: THE UNTOUCHABLES

Actor: _____

4) Movie: NEVER CRY WOLF

Actor: _____

5) Movie: SILVERADO

Actor: _____

6) Final Movie: [SOAP DISH] 82 front

10

80

Figure 4a

80

1) Starting Movie: BEETLEJUICE

Actor: Alec Baldwin

2) Movie: THE HUNT FOR RED OCTOBER

Actor: Sean Connery

10

3) Movie: THE UNTOUCHABLES

Actor: Charles Martin Smith

4) Movie: NEVER CRY WOLF

Actor: Brian Dennehy

5) Movie: SILVERADO 84

Actor: Kevin Kline

6) Final Movie: SOAP DISH back

Figure 4b

BOARD GAME AND METHOD OF PLAYING THE SAME

FIELD OF THE INVENTION

The present invention in general relates to board games, and in particular to a board game method that involves providing the correct factual connections or linkages between related questions presented in a group or in a sequential order, such as a movie title, and actor, and successive movie titles and actors.

BACKGROUND OF THE PRESENT INVENTION

Board games of many types and varieties are well known. Many include a board having a playing surface with a particular playing path marked out it upon which the game players move an individualized game piece from a designated starting space to a designated finishing space. These games often incorporate one or more cards or card sets that determine exclusively or under particular circumstances how a game player will move his game piece on the board. For example, a children's game sold under the mark "Candy Land" includes a board having a playing path marked out with spaces of particular colors. The game further includes a card set, most of which have one (sometimes two) colored square. Upon drawing a card, a player will move his game piece to the next playing path space of the same color as that shown on the drawn card. Other games, such as the well known game of Monopoly™ include a playing path upon which the player moves his game piece, occasionally according to the dictates of a card drawn from card set on the board. Another game that utilizes a game board and a card set is Trivial Pursuit™, where the playing path has the configuration of a wagon wheel with spokes. In this game, a player rolls a die, moves on the playing path a number of spaces equal to the number of pips showing on the die, and then must answer a question in a question corresponding to the category of the space upon which his game piece landed. A successful answer results in the player being awarded a marker corresponding to that particular category of question. After correctly answering questions in all of the categories, the player heads toward the center of the board along one of the spokes and must answer correctly one question from a category chosen by the other game players. This latter game is of the question and answer type, of which several varieties exist, some of which utilize a board with a playing path and some which do not.

The question and answer type of games often have a variety of categories in which questions are asked and responses given. For example, Trivial Pursuit™ has cards that include six categories of questions on one side thereof with the other side including an answer for each of the categories. The categories include such broad subjects as science, sports entertainment, etc. Other games may be devoted to single categories, broadly speaking, of questions and answers. For example, a sports trivia game may have subcategories of professional basketball, college basketball, professional football, college football, professional baseball and college baseball. Each of these known board games relies, however, upon a contestant providing an answer to a specific question and thus, while testing a game player's knowledge, does not test his ability to link specific facts common to a pair of events or happenings.

U.S. Pat. No. 5,145,184 to Yearick provides a representative example of known question-and-answer games involving linkages between common elements. The game disclosed in the Yearick '184 patent is marketed under the name TRIBOND™, and requires players to identify the common relationship between three items. For example, a question is phrased as a listing of three items: a car, an elephant, and a tree. The correct answer is the common bond between the three: a trunk. The players select questions from card sets having multiple categories, such as film, history, current events, and sports. There are also "challenge" questions, and questions with undesignated or mystery categories.

As with games such as Trivial Pursuit™, the Yearick '184 game is relatively one dimensional. Questions each have the same point values even though there relative difficulty to particular players can differ drastically and unpredictably, and the game proceeds in a very linear and predictable fashion.

SUMMARY OF THE INVENTION

It is an object of the present invention to provide new and improved apparatus that is not subject to the foregoing disadvantages.

It is another object of the present invention to provide a new and improved board game that tests a game player's knowledge of a particular category of knowledge by requiring the game player to recite specific factual connections between a common category and one or more subcategories.

It is still another object of the present invention to provide a new and improved board game that tests a game players' knowledge of the motion picture industry by requiring the game player to successfully provide the factual connection between two motion pictures.

It is yet another object of the present invention to provide a new and improved board game that tests a game players' knowledge of the motion picture industry by requiring the game player to successfully name an actor/actress who had roles in both motion pictures.

In another embodiment of the present invention, it is an object of the present invention to provide a new and improved board game that tests a game player's knowledge of the motion picture industry by requiring the game player to successfully link a series of movies by naming a common actor in a first and second movie, a common actor in the second and a third movie, and so on.

It is further an object of this invention to design the above board game and game method such that it may be readily adapted to embodiments played on computers or hand-held game devices, particularly utilizing multimedia capabilities such as CD-ROM, or may be conducted as a game show program particularly suited for televised performances.

The foregoing objects of the present invention are provided by a game having a card set and a game board with a predetermined playing path laid out thereon upon which the game players move their game pieces according to the rules of the game. The playing path is subdivided into a plurality of spaces and includes a starting space and a finishing space. In the embodiments of the game disclosed herein, the playing path is laid out in the shape of a star having five points. To move about on the board the question answering player selects a card from the card set. In one embodiment of the present invention the cards will include a common category and a plurality of subcategories, each subcategory having a factual or linking connection to the common category, though not necessarily with the other subcategories. To earn points which equate with moving a game piece about the board the equivalent number of spaces, the question answering player must provide the connection between the common category and one or more subcategories. In the embodiment disclosed herein, the common category is a movie (or motion picture) and the subcategories are also motion pictures. The linking or factual connection between the common category and the subcategories includes actors/actresses having roles in both pictures, their directors, producers, etc.

In another embodiment of the present invention, the card set includes cards having a starting category and an ending category with a plurality of intermediate categories without requiring a particular order therebetween. The question answering player must provide a linking or factual connection between the starting category and a first intermediate category. The question answering player can earn additional points and thus move further along the board by providing further linking or factual connections between the first intermediate category and a second intermediate category, the second intermediate category and a third intermediate category, etc. until a linking or factual connection between the last remaining intermediate category and the ending category is provided. As with the first embodiment disclosed herein, the categories of this embodiment disclosed herein relate to the motion picture industry.

The foregoing objects of the invention will become apparent to those skilled in the art when the following detailed description of the invention is read in conjunction with the accompanying drawings and claims. Throughout the drawings, like numerals refer to similar or identical parts.

BRIEF DESCRIPTION OF THE DRAWINGS

FIG. 2*a* is a view of the front side of a card used with the game board shown in FIG. 1 in accord with the present invention;

FIG. 2*b* is a view of reverse side of a card set used with the game board of FIG. 2*a;*

FIG. 4*a* is a view of a front side of a card used with the game board shown in FIG. 3 in accord with the present invention;

FIG. 4*b* is a view of the reverse side of the card shown in FIG. 4*a;*

FIG. 5 is a detail view of a portion of the game board of FIG. 3 showing the intersection between multiple paths on the game board;

FIG. 6 is a perspective view of a card holder for use with the card sets in a game in accord with the present invention;

DETAILED DESCRIPTION OF THE INVENTION

Figure 1:
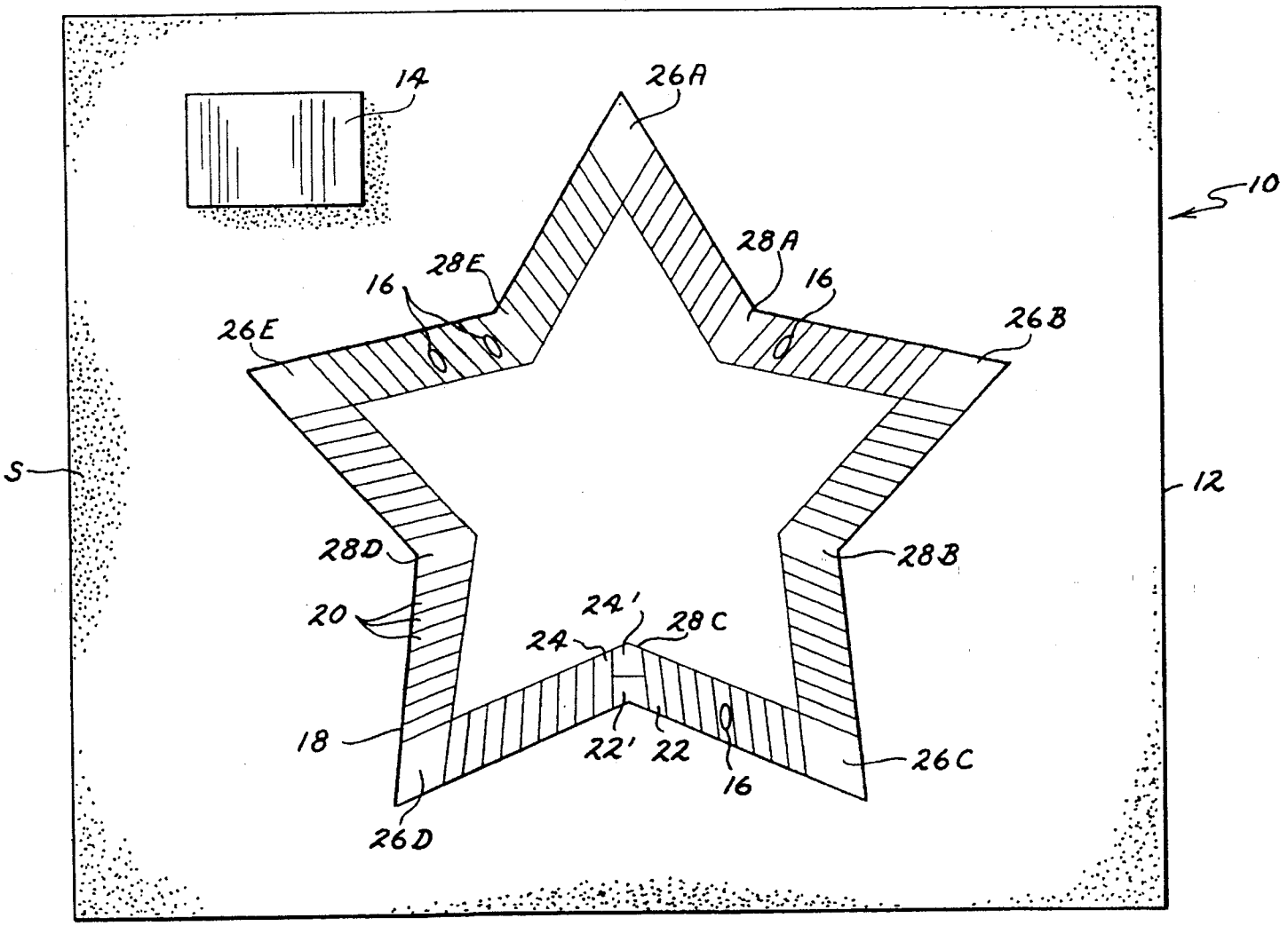
FIG. 1 is a plan view of a first embodiment of a game board used with a game in accord with the present invention.

FIGS. 1, 2*a*, and 2*b* illustrates related embodiment of a game 10 in accord with the present invention. Board game 10 includes a board 12 which may have an appropriate background shading S and visible printing thereon, a card set 14, and a plurality of playing pieces 16 which the game players move about the board 12. Board 12 includes a predetermined playing path 18 laid out in the configuration of a star having five point spaces, 26A, 26B, 26C, 26D, and 26E. Playing path 18 is subdivided into a plurality of playing spaces 20, inclusive of a starting space 22 and a finishing space 24. The spaces on the designated points 26A–26E are marked with the legend "Gain a Turn" while the vertex space, 28A, 28B, 28C, 28D, and 28E are marked with the legend "Lose Turn." Alternately, one of the spaces 20 such as a vertex 28C may be subdivided to form the starting space 22' and finishing space 24'.

Referring to FIG. 2*b*, a playing card 30 will be discussed. It may be appreciated from the following description of the board game 10 that in some embodiments a folded or shielded card 30 may be preferred to prevent premature exposure of questions or answers to other players while one player is holding the card 30.Card 30 is one of the plurality of cards shown in card set 14.

Each card 30 includes a front, or obverse, side 32 and a back, or reverse, side 34. Front side 32 includes a common category 36, shown herein as a movie title, and in this particular instance, the movie title "Beetlejuice." Arrayed about the common category are a plurality, here five, of subcategories 38. Each subcategory 38 is also a movie title. As shown in FIG. 2*a*, the common category is centered in a figure having the shape of a star, much like the playing path 18, and the subcategories are arrayed thereabout with one subcategory being at each of the five points of the star shaped common category. The common category 36 and each of the subcategories 38 are linked by a specific factual connection. In the example shown herein, the factual connections are actors, male or female, who had roles in both films. Thus, for example, the category "Beetlejuice" and the subcategory "Batman" are linked by an actor who had acting roles in both movies. Providing the correct name of that actor is worth one point, as indicated by a point value shown on the card 30 corresponding to that subcategory. (The subcategories are numbered in parentheses on the front side 32 of the card 30 as shown in FIG. 2*a* for purposes of correlating the correct answers on the back side 34 of the card 30, and the point values may be shown to the players in any suitable way.) The point total increases in response to the perceived increased difficulty in correctly providing the factual connection linking the common category with the subcategories. Thus, for example, it is believed to be comparatively easier to provide the correct factual connection between "Beetlejuice" and "Batman," which is worth one point to the answering player, than it is to provide the factual connection between "Beetlejuice" and "Amadeus," which is worth three points. Typically, a card will have two questions considered easy and thus worth one point, two questions considered moderately difficult and thus worth two points, and one question considered difficult and worth three points. Thus, a typical card will have a total of nine points available for the players to earn (or to lose as to be described below).

The factual connections between the common category and the subcategories are shown in FIG. 2*b*, which is the back or reverse side 34 of the card 30. It can be seen that the answers provided there include the actors name. The game can be also targeted at a level of difficulty that makes the game fun for players of different levels of knowledge. For example, where a game is to be played amongst people who rarely go to movies, it can be decided that only the last name of the actor need be given to be correct. Where the game is played by persons who frequently attend films, it may be decided that the full name of the actor needs to be given, as well as, perhaps, the name of the character played by the actor in the common category film. If desired, additional points could also be awarded additional points can be awarded for providing the names of the characters played in the common category, the subcategory, or both.

As the game is played on the board 12, a starting player will be chosen who will be the first answering player. A card will be drawn from the card set 14 by one of the other players who will then show the front or obverse side of the drawn card to the answering player. The answering player will provide the factual connections between as many of the subcategories and common categories as he or she can. Points will be added up for the correct answers given. When the answering player has finished providing all of the factual connections known to that player, play passes to the next player who may then provide additional factual connections for as many of the category/subcategory connections are left as that player is able to provide. This is termed a "fill-in." If the next player does not know any factual connections, the player may pass, and play will move to the next player.

If a player desires to do so, the player may "bluff" and provide a factual connection known or believed to be false. If the "bluff" is unchallenged by another player, the bluffing player will receive the appropriate points. Thus, a game played according to the method of playing disclosed herein may further provide for challenges to the answering player's responses. Thus, where a player believes the answering player's responses to be incorrect, a challenge can be made, with the challenging player receiving points equal to the challenged answers and the answering player having points subtracted equal to the successfully challenged answer. Where the challenging player is incorrect in the challenge the challenging player will have points deducted equal to the challenged question's assigned points, or lose a turn if the players does not have sufficient points available from which to deduct.

At the end of a turn for a player, the player's point totals may be added together and the player's game piece, such as game piece 16 will be moved forward along the playing path an equivalent number of spaces as the point total. At the end of play on a particular card, the card will be placed at the bottom of the card set and the top card drawn for continuing play. Play continues with the new card with the player to the left (or right depending upon which direction around the table play is proceeding) of the previous answering player. Play will continue in this manner until one player reaches the finishing space 24, thus winning the game.

Figure 3:
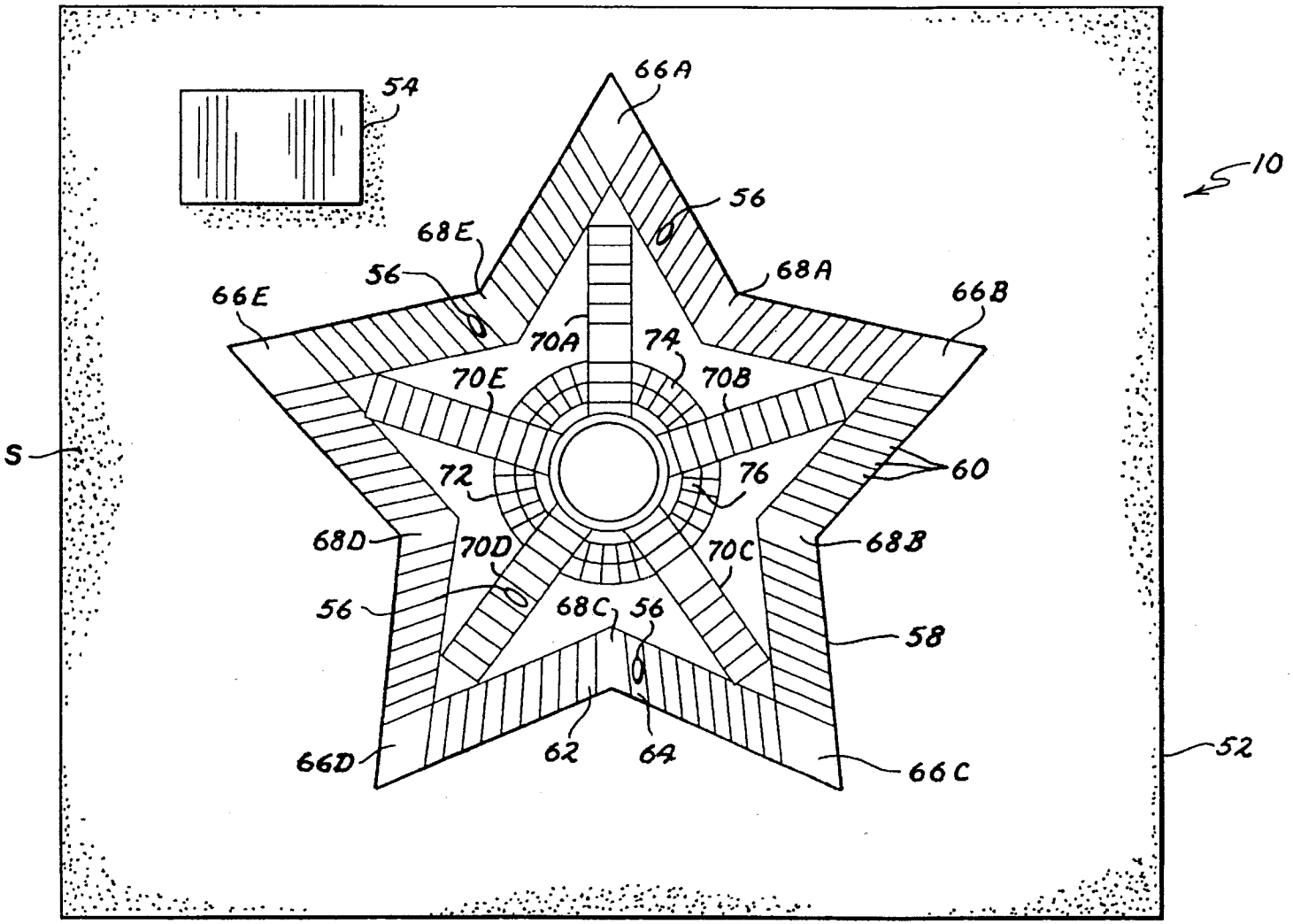
FIG. 3 is a view of third embodiment of a game board used with a game in accord with the present invention.

Referring now to FIG. 3, another embodiment of the game 10 in accord with the present invention is shown. Game 10 includes a game board 52, card set 54, and game pieces 56. Game board 52 includes a playing path 58 laid out in the shape of a five pointed star, the path 58 including a plurality of spaces 60 upon which the game pieces 56 are moved during the game. Playing path 58 also includes a designated starting space 62 and finishing space 64. Playing path 58 includes five point spaces 66A, 66B, 66C, 66D, and 66E as well as five vertex spaces 68A, 68B, 68C, 68D, and 68E, each marked "Gain a Turn." Playing path 58 also includes a plurality of spokes, here five, 70A, 70B, 70C, 70D, and 70E, each of which comprise a plurality of playing spaces and each of which extends radially from a point of the star shaped playing path inwardly to intersect with a circular ring 72 of playing spaces and the center circle 74. If desired, two or more of the playing spaces on each of the spokes 70A–70E may be marked "Lose a Turn." For example, in the embodiment shown in FIG. 3, the spokes 70 each have a "Lose a Turn" space as the first space interior to ring 72 and another "Lose a Turn" space as the seventh or eighth space from the radially outer end of the spoke. It will be further observed that the ring 72 is divided into two tracks, 74 and 76, with track 74 being radially inwardly from track 74. The spaces of tracks 74 and 76 that intersect the spokes 70A–70E are each marked "Detour." Movement on the board 52 with the game pieces 56 will be explained with reference to the cards to be discussed below.

As seen in FIGS. 4*a* and 4*b*, a card 80 of card set 54 is shown. Card 80 includes a front or obverse side 82 and a back or reverse side 84. As seen on the front side 82, the card includes a beginning subject, here a movie title, and an ending subject, again a movie title. In between the beginning and ending subjects are four other intermediate subjects, once again movie titles. The answering player must provide the factual connections or links between the subjects (movies) from the beginning subject (movie) to the ending subject (movie), with points being earned for providing the factual connections or links. As shown in the representative cards 4A and 4B, the overall subject is again the motion picture industry. In this situation, the factual connections or links could be actors who appeared in the movies, directors, etc. For example, where the starting movie is "Beetlejuice," the ending movie is "Soapdish," and the intermediate movies are "The Hunt for Red October," "The Untouchables," "Never Cry Wolf," and "Silverado," and where the factual connections between the movies are actors, the factual connections between them could be:

| | |
|---|---|
| Beginning Movie | "Beetlejuice" |
| Actor in both movies: | ALEC BALDWIN |
| Intermediate Movie | "The Hunt for Red October" |
| Actor in both movies: | SEAN CONNERY |
| Intermediate Movie | "The Untouchables" |
| Actor in both movies: | CHARLES MARTIN SMITH |
| Intermediate Movie | "Never Cry Wolf" |
| Actor in both movies: | BRIAN DENNEHY |
| Intermediate Movie | "Silverado" |
| Actor in both movies: | KEVIN KLINE |
| Ending Movie | "Soapdish" |

Stated otherwise, the answering player will attempt to provide the name of the actor in common in the starting movie and one of the intermediate movies, the name of the actor in common between the previously named intermediate movie and another of the intermediate movies, and so on until a factual connection or link is provided between the final remaining intermediate movie and the ending movie. Points are awarded for each factual connection provided, to bring the point total available on each card to five. Once again, the answering player would move his playing piece a number of spaces equal to the earned point total. Once play on the card has ended and the player has moved the game piece the appropriate number of spaces, the card is placed at the bottom of the card set and a different player becomes the answering player with a new card.

As with the previously described embodiment, one of the other players may challenge an answering player's answer. The challenge must be made before the card is replaced in the deck and a new card drawn for the next player. Challenges may be made where less than all of the factual connections were provided by the answering player, where a challenging player believes that incorrect factual connections were given, or for any other type of mistake. Where the challenging player can correctly provide the missing factual connections or identify a mistaken factual connection, the challenging player can "steal" all of the points on the card from the answering player. Where the challenging player is incorrect in his or her answers, the challenging player will lose a turn. If two or more players should challenge an answering player's factual connections, the player immediately to the left around the table will be given the opportunity to "steal" the points.

Where a player has landed on a "Lose one Turn" space, that player may still be allowed to issued challenges, with the points gained from a successful challenge being added to the player's point total at his or her next turn. Where the challenging player is unsuccessful in this instance, however, an additional turn is lost.

Play will proceed around the table with each player moving his or her piece along the playing path 58 from the starting space 62 to the finishing space 64. There are two possible paths to follow to the finishing space 64, however. The first is along the perimeter track defined by the star shaped path. The second path is to take one of the spokes 70A–70E though the center of the board 52. The perimeter pathway is longer, but there are "Gain One Turn" spaces scattered thereabout and fewer pitfalls of the type that may befall someone taking one of the shortcut routes, such as the "Lose One Turn" spaces. In addition, to proceed through the center circle 74 the player must have the exact number of points to land in the center circle 74. Furthermore, if a player were to land on the "Detour" space, the player would be forced to detour in the direction indicated by the arrow around either the inner or outer track 74, 76 respectively, as shown particularly in FIG. 5. The player would be forced to stay on this track until presented with an opportunity to get off at the next spoke. Strategically, an answering player could answer only so many questions as would provide exactly the correct number of points to land in the center circle 74. This would, however, leave the answering player open to a challenge by a player who could then "steal" the points on the card.

While the present invention has been explained relative to using the motion picture industry as the categories of interest, other subject areas could also be used. For example, the television industry could be used in a similar manner with the titles of television series replacing those of the movies. The game could be directed to distinct categories such as fields of science, history, art, geography, current events or specific periods relative to another category, sports or other entertainment, and virtually any subject of interest. Similarly, variations of the game could be directed towards types of movies, such as action, family, comedy, musical, foreign, etc, or other subclassifications of any category. In addition, the present invention contemplates its ready use in personal computers or hand-held game units, as well as updates of the card set at selected intervals.

It may be readily appreciated that the game of the present invention as described above may be conducted with players being presented questions in a sequential order, such as corresponding to the embodiment described in FIGS. 3, 4*a*, and 4*b*, or in a single group, such as corresponding to the embodiment described in relation to FIGS. 1, 2*a*, and 2*b*. The selection between grouped or sequential ordering is completely independent of the configuration of the particular game board 10 being utilized, the point values being assigned to correct responses, or the scoring method used.

Referring to FIG. 6, it is anticipated that one optional feature is a tray or card holder 86 designed to retain a plurality of cards 30 or card sets 14 in a generally vertical stack, with an upright aperture 88 disposed along one or both ends designed to facilitate easy withdrawal of individual cards 14 from the top of the stack.

In a computer or hand-held game unit version, the board 12, card set 14, and playing pieces 16 may be graphical representations of the physical counterparts, or they may be registers for the corresponding information. For example, the playing pieces 16 may be on-screen name or player designations and the memory log of corresponding total point values which that player has earned. The card set 14 could be a database of questions posed to the players. The board 12 could be any structured representation of the game environment, ranging from a simple linear tally of players' scores to a more complex path that players navigate by entering commands to select changes in directions or other choices between differing alternatives. In simplest form, the game 10 would involve the selection of an answering player, presentation of a question selected either randomly or by a predetermined algorithm, recitation of one or more factual connections, verification of correct answers by the processor using the database, the awarding of points corresponding to the correct answers, and tallying the awarded points for the answering player. It is anticipated that far more complex versions of the game may also be fashioned using a computer and graphic user interface, in which one or more boards with divergent pathways may be designated, including both perceptible and hidden pathways, obstacles, and situations, and wherein the future course of the game 10 is affected by past occurrences in the game 10, random events, or the data input by various players in response to specified conditions.

Figure 7:
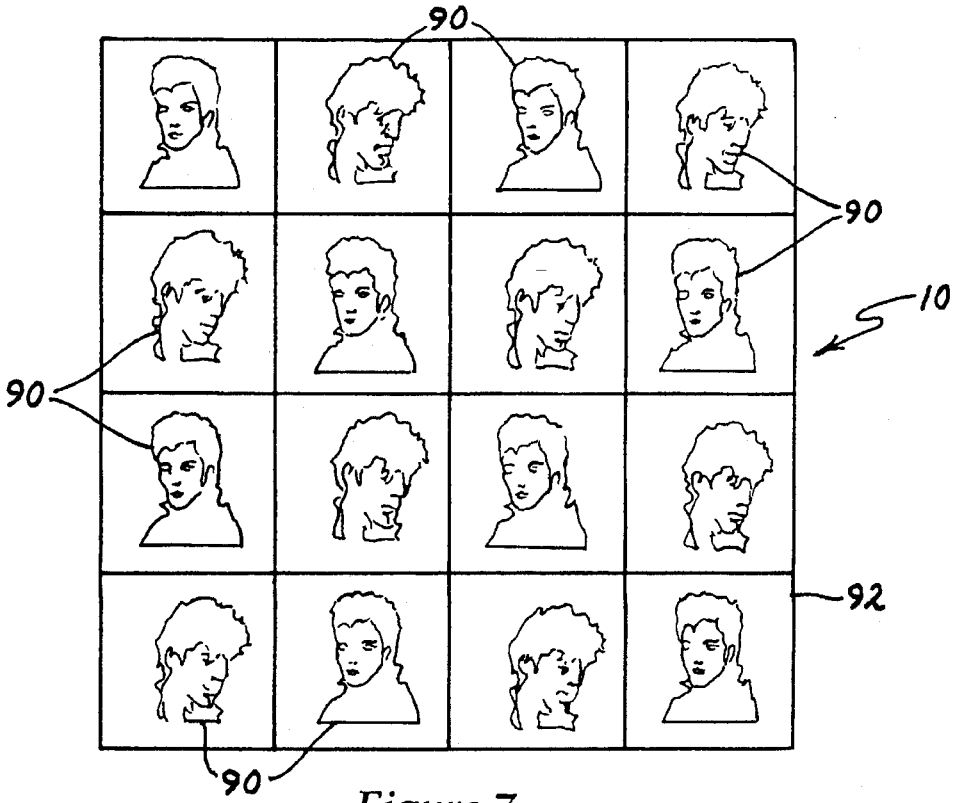
FIG. 7 is a view of a display configuration used with a multimedia embodiment of a game in accord with the present invention.

Referring particularly to FIG. 7, one computer version of the present game suitable for an interactive multimedia interface is shown diagrammatically. A player initiates a game sequence by pressing a key (not shown), electing a category or other indicia controlling the discrimination or selection of an a first set of game information, or that first game set is determined by the program at random or according to predefined parameters. A plurality of personal images 90 are presented on the display 92 (shown generically as alternating male and female images in FIG. 7), and the player selects one of the images. A question would then appear on the screen adjacent to the images (or could be spoken by a speech synthesizer or digitized recording), prompting the player to select another personal image 90 on the display 92 corresponding to an individual who satisfies the linkage or other designated criteria. Correct selection of the personal image 90 relating to the individual satisfying the designated criteria prompts another question to be displayed (for example, in the position formerly occupied by the selected personal image 90), and the player to select another personal image 90. The group of personal images 90 initially displayed could be exhausted sequentially, rearranged in location prior to each step in the sequence, or may be completely replaced by one or more new personal images 90 at each step in the sequence.

Because of the capabilities of multimedia, the personal images 90 shown in FIG. 7 may be replaced or augmented by spoken quotations or other audio output, animated video clips, or similar types of information.

Figure 8:
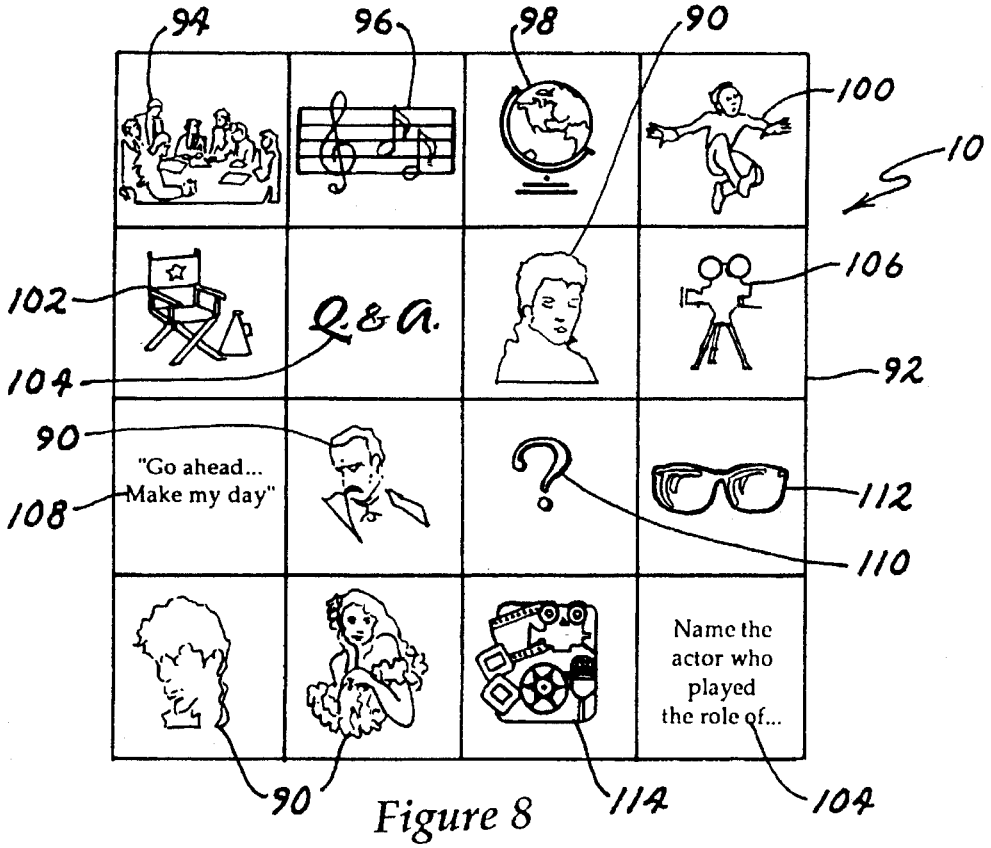
FIG. 8 is a view of an alternate display configuration used with another multimedia embodiment of a game in accord with the present invention.

Referring to FIG. 8, a modified embodiment of the multimedia game described above in relation to FIG. 7 is shown, particularly suited to be conducted as a game show program for televised performances. Instead of an initial array of personal images 90, the display 92 may present an array of different categories or information sets, either exposing all or a portion of the information set (clue or question) or a design or emblem identifying a predetermined category or type of question. For example, one or more elements of the array might correspond to personal images 90, stills or animated video clips from motion pictures 94, musical audio selections 96, geographical information 98, characters 100, directors 102, textual questions 104, movie titles 106, quotations 108, mystery or unclassified questions 110, mystery persons or personal descriptions 112, and technical information 114. Of course, these are shown merely as representative examples in the context of a movie or television-based subject matter game.

As previously described, a player is selected and sequentially answers questions through an alternating pattern of identifying an element in the array, correctly determining the linkage between first and second items of information, and selecting another element in the array and providing the correct information linked to the second item of information in the preceding question. As an example, a player might select a questions from the category of quotations 108 and be presented with the quote "Go ahead . . . Make my day." The player might relate this quotation to the identity of the actor (Clint Eastwood), the name of the corresponding film, the geographic location the film, the director, etc. In one version, the player could then select one of the categories and provide the correct answer—for example "actor" and "Clint Eastwood." The corresponding element in the array would then either present the player with a new actor from the same film whom the player must identify, or the elements of the array will be replaced with new elements including visual depictions from which the player must select a correct element corresponding to Clint Eastwood. In another version, a player's correct answer might cause the apparently random selection of another array element, which then presents a second set of information related to Clint Eastwood, thus requiring the player to correctly provide the linkage. A correct linkage would then cause the apparently random selection of a new element in the array, and a third set of information for the player to identify the correct linkage. In a non-sequential version of the game, a first information set would be designated, and some or all of the elements in the array may be selected by the player and the correct linkages or answers provided. In either case, scoring may be cumulative based upon the number of linkages provided, the number of questions answered or steps taken, and using point values that vary depending upon the difficulty of the individual questions or the length of the sequential chain.

A further embodiment particularly suited for applications involving multimedia technology or televised performances includes a virtual reality aspect, in which the player answering the questions is immersed in a virtual reality environment composed of the visual and aural indicia associated with the particular question. For example, using the category of motion pictures as a further example, the player might be placed in a scene where they view Tom Cruise speaking to them in a courtroom setting and saying "Did you order the code red?" The player would then have to draw a correct link to the actor or from whose perspective the player resides—Jack Nicholson as Colonel Nathan Jessup in the movie "A Few Good Men." Based upon the complexity of the game 10, the player might be required to provide the actor's name, role, name of the movie, location of the setting, or a quotation comprising the correct reply to the statement made by the first actor, each of which might be assigned differing point values based upon the difficulty of the question. Upon giving a correct answer, the visual and aural indicia would change to a new motion picture setting involving the actor, role, movie, setting, etc. associated with the previous actor from whose perspective the player visualized the preceding question. In the example given above, the player might then be transferred to a new setting where they are viewing Jack Nicholson in a different role from a different movie, and must determine the actor or role from whose perspective they are viewing the scene. It may be appreciated that this interactive multimedia version of the game could be accomplished without the use of virtual reality equipment, however its use would be expected to present the player with an enhanced entertainment experience.

The present invention having thus been described, other modifications, alterations, or substitutions may now suggest themselves to those skilled in the art, in light of technology now existing and developed in the future, all of which are within the spirit and scope of the present invention. It is therefore intended that the present invention be limited only by the scope of the attached claims below.

What is claimed is:

1. A game comprising:

a plurality of game pieces for a plurality of game players;

a game board, said board including a playing path, said playing path including a plurality of spaces on which players can move their pieces between a designated starting space and a designated finishing space;

a card set including a plurality of cards, each said card including game information in a first set and a second set, said first set of game information including a common category and a plurality of subcategories, said subcategories being connected to said common category by a factual connection, and said second set of game information including the factual connections between the common category and each subcategory in the first set of game information for said card, each connection being assigned a point value for an answer correctly identifying the connection between the category and the subcategory;

wherein each player is awarded the corresponding point value upon each correct factual connection said player provides and said player moves their game piece a number of spaces on said playing path equal to the total number of point values awarded.

2. The game of claim 1 wherein said playing path is configured as a star having five points and wherein said first set of game information includes five subcategories, said first set of game information being arrayed on a front side of said cards with said common category in the center and said five subcategories arranged thereabout in the shape of a star having five points.

3. The game of claim 1 wherein said common category is a movie and each of said plurality of subcategories is a movie and wherein the factual connection between the common category and each said subcategory is the identity of an actor who had a role in both the common category movie and the subcategory movie.

4. The game of claim 3 wherein the factual connection between the common category and a particular subcategory are provided in a correct sequential order.

5. The game of claim 1 wherein said playing path is configured as a star having five points and five inner vertexes, and wherein said first set of game information includes five subcategories, said first set of game information being arrayed on a front side of said cards with said common category in the center and said five subcategories arranged thereabout in the shape of a star having five points, said playing path including spaces marked "Lose Turn" disposed at the inner vertexes of said star shaped playing path and spaces marked "Gain One Turn" disposed at the points of said star shaped playing path.

6. The game of claim 1 wherein said playing path is configured as a star having five points.

7. The game of claim 1 wherein the points awarded for providing a factual connection increase as the difficulty of the factual connection increases.

8. A game comprising:

a plurality of game pieces for a plurality of game players;

a game board, said board including a playing path, said playing path including a plurality of spaces on which players can move their pieces between a designated starting space and a designated finishing space;

a card set including a plurality of cards, each said card including a first set and a second set of game information, said first set of game information including a beginning subject and an ending subject and a plurality of intermediate subjects interposed therebetween, said beginning subject being connected to said ending subject through said intermediate subjects by a plurality of factual connections linking two of said subjects, each factual connection being assigned a predetermined point value for an answer identifying the connection between two of said subjects;

wherein a player is awarded the point values for each factual connection the player provides and the player moves his game piece a number of spaces on said playing path equal to the total number of point values awarded.

9. The game of claim 8 wherein said playing path includes:

a perimeter path segment configured as a star having five points and five inner vertexes;

a circle disposed at the center of said perimeter path;

a ring path segment disposed radially outward from said circle and inwardly from said perimeter path;

a plurality of spoke segments, each spoke segment extending substantially radially inwardly from one of said points to said circle, each said spoke segment intersecting said ring path segment.

10. The game of claim 9 wherein said ring path segment comprises inner and outer tracks.

11. The game of claim 9 wherein the spaces at the intersection of said ring path segment and said spokes are marked "Detour."

12. The game of claim 9 wherein the spaces at the points of the perimeter segment are marked "Gain One Turn" and the spaces at the inner vertexes of said perimeter path are marked "Lose One Turn."

13. The game of claim 8 wherein said subjects are movie titles and the factual connections are actors in common between the subjects.

14. A method for playing a board game with at least one player comprising:

providing each player with a playing piece;

providing a game board having a playing path including a plurality of spaces on which the players can move their playing pieces, one of said spaces being designated as a starting space and one of said spaces being designated as a finishing space;

providing a card set including a plurality of cards, each said card including a first set and a second set of game information, said first set of game information including a first category and at least one second category, said at least one second category being connected to said first category by a factual connection, and said second set of game information including the factual connection between the first category and said at least one second category in the first set of game information of said card, said factual connection being assigned a point value for identifying the factual connection between the first category and the at least one second category;

identifying an answering player to draw a selected card from said card set;

permitting the answering player to recite one or more of the factual connections between the first category and said at least one second category;

calculating the total number of points said answering player earns for correctly reciting the factual connections;

advancing the answering player's playing piece upon the playing path through a number of playing spaces equal to the total number of points calculated; and repeating said identifying, calculating, and advancing steps until a player reaches the finishing space.

15. The game of claim 14 wherein said first category is a common category and said at least one second category is one of a plurality of subcategories, and said second set of game information includes a factual connection between said common category and each said subcategory, said method further including:

permitting other players to recite factual connections between the common category and any subcategory not responded to by the answering player;

calculating the number of points earned by the other players based upon the correct factual connections provided thereby; and advancing the other player's playing pieces the calculated number of points.

16. The method of claim 15 wherein said method further includes:

challenging the factual connections provided by an answering player; and reviewing the second set of game information for the selected card to determine the correct answer, and a. awarding the challenging player the point value if the answering player's recited connection is incorrect and subtracting the point value from the answering player if the challenging player is correct; or b. subtracting the point value from the challenging player if the answering player is correct.

17. The method of claim 14 wherein said common category is a movie and said subcategories are movies and said connection is an actor who appeared in both the common category movie and the subcategory movie.

18. The method of claim 14 wherein said first category is a starting category, said second category is an ending category, said first set of game information includes at least one intermediate category and said second set of game information includes a factual connection linking said starting category and said at least one intermediate category and a factual connection linking said at least one intermediate category to said ending category, and wherein said method further includes:

awarding a point value to the answering player for providing the factual connections linking the categories.

19. The method of claim 18 wherein the factual connections linking the categories are provided in a correct sequential order.

20. The method of claim 18 wherein said method further includes:

challenging the factual connections provided by an answering player; and reviewing the second set of game information for the selected card to determine the correct answer, and a. awarding the challenging player the point value if the answering player's recited connection is incorrect and subtracting the point value from the answering player if the challenging player is correct; or b. subtracting the point value from the challenging player if the answering player is correct.

21. The method of claim 20 wherein said categories are movie titles and said factual connections are actors who had roles in the linked categories.

22. The method of claim 18 and further including:

filling in the factual connections not provided by the answering player and awarding the corresponding point value to the player providing the filled in factual connections.

23. A method for playing a board game with at least one player comprising:

providing the at least one player with a plurality of questions, each of said plurality of questions including a first set and a second set of game information, said first set of game information including a first category and at least one second category, said at least one second category being connected to said first category by a factual connection, and said second set of game information including the factual connection between the first category and said at least one second category in the first set of game information of said card, said factual connection being assigned a point value for identifying the factual connection between the first category and the at least one second category;

identifying an answering player from among the at least one player, said answering player to answer a selected one of the plurality of questions;

permitting the answering player to recite one or more of the factual connections between the first category and the at least one second category for the selected one of the plurality of questions;

awarding a point value for each of the one or more factual connections correctly recited by the answering player;

calculating the total of the point values said answering player earns for correctly reciting the factual connections for the selected question; and repeating said identifying, permitting, awarding, and calculating steps until one of the at least one players reaches a predetermined goal of the total of the point values.

* * * * *